US008793125B2

(12) United States Patent
Breebaart et al.

(10) Patent No.: US 8,793,125 B2
(45) Date of Patent: Jul. 29, 2014

(54) METHOD AND DEVICE FOR DECORRELATION AND UPMIXING OF AUDIO CHANNELS

(75) Inventors: Dirk Jeroen Breebaart, Eindhoven (NL); Erik Gosuinus Petrus Schuijers, Eindhoven (NL); Heiko Purnhagen, Sundbyberg (SE); Karl Jonas Rödén, Solna (SE)

(73) Assignees: Koninklijke Philips Electronics N.V., Eindhoven (NL); Coding Technologies AB, Stockholm (SE)

( * ) Notice: Subject to any disclaimer, the term of this patent is extended or adjusted under 35 U.S.C. 154(b) by 1321 days.

(21) Appl. No.: 11/571,838

(22) PCT Filed: Jul. 11, 2005

(86) PCT No.: PCT/IB2005/052293

§ 371 (c)(1),
(2), (4) Date: Jan. 9, 2007

(87) PCT Pub. No.: WO2006/008697

PCT Pub. Date: Jan. 26, 2006

(65) Prior Publication Data

US 2008/0091436 A1 Apr. 17, 2008

(30) Foreign Application Priority Data

Jul. 14, 2004 (EP) ..... 04103370
Apr. 18, 2005 (EP) ..... 05103072

(51) Int. Cl.
*H04R 5/04* (2006.01)
*H04S 3/00* (2006.01)
*H04S 5/00* (2006.01)

(52) U.S. Cl.
USPC ..... 704/216; 704/500; 381/1; 381/17

(58) Field of Classification Search
CPC ..... H04R 5/04; H04S 3/00; H04S 5/00
USPC ..... 704/216, 500, 501, 502; 381/1, 10, 17, 381/19, 20, 22, 307
See application file for complete search history.

(56) References Cited

U.S. PATENT DOCUMENTS 5,119,422 A * 6/1992 Price ..... 381/303
5,136,650 A * 8/1992 Griesinger ..... 381/22

(Continued)

FOREIGN PATENT DOCUMENTS

EP 1054575 A2 11/2000
EP 1376538 A1 1/2004

(Continued)

OTHER PUBLICATIONS

Avendano et al., "Frequency Domain Techniques for Stereo to Multichannel Upmix", 22nd International Conference on Virtual, Synthetic and Entertainment Audio, Jun. 2002, pp. 1 to 10.*

(Continued)

*Primary Examiner* — Martin Lerner
(74) *Attorney, Agent, or Firm* — Michael A. Glenn

(57) ABSTRACT

A device (1) for converting a first number (M) of input audio channels into a second, larger number (N) of output audio channels comprises: decorrelation units (3) for decomposing the input audio channels into a set of decorrelated auxiliary channels, at least one upmix unit (4) for combining the decorrelated auxiliary channels into the output audio channels, and at least one pre-processing unit (2) for pre-processing the input audio channels and feeding the pre-processed input audio channels to the decorrelation units (3). The pre-processing unit (2) and the upmix unit (4) are preferably controlled by audio parameters.

13 Claims, 4 Drawing Sheets

(56) References Cited

U.S. PATENT DOCUMENTS

Figure 1:
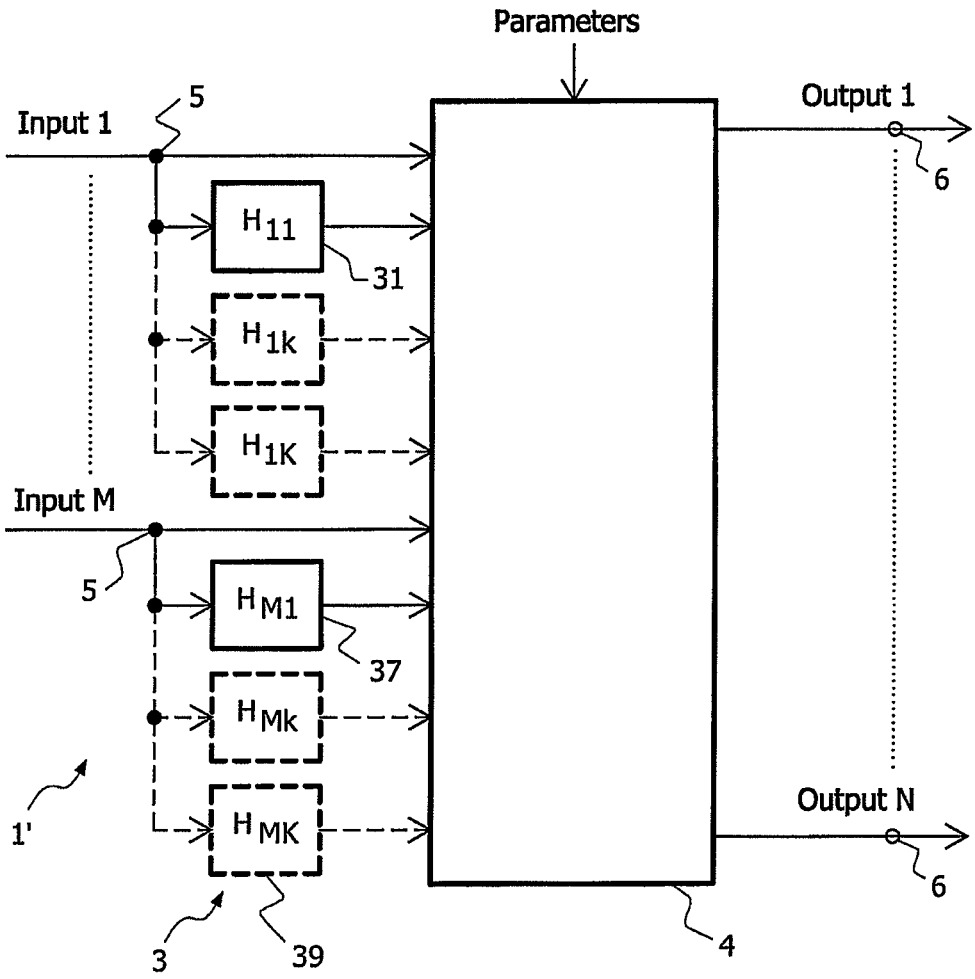
FIG. 1 PRIOR ART

| | | | | |
|---|---|---|---|---|
| 5,222,059 | A * | 6/1993 | Holman | 369/89 |
| 5,621,818 | A | 4/1997 | Tashiro | |
| 5,701,346 | A | 12/1997 | Herre et al. | |
| 5,706,309 | A | 1/1998 | Eberlein et al. | |
| 5,812,971 | A | 9/1998 | Herre | |
| 5,844,993 | A | 12/1998 | Iida et al. | |
| 5,870,480 | A * | 2/1999 | Griesinger | 381/18 |
| 6,539,357 | B1 * | 3/2003 | Sinha | 704/270.1 |
| 6,711,266 | B1 | 3/2004 | Aylward | |
| 7,006,636 | B2 | 2/2006 | Baumgarte et al. | |
| 7,181,019 | B2 * | 2/2007 | Breebaart et al. | 381/23 |
| 7,343,281 | B2 * | 3/2008 | Breebaart et al. | 704/205 |
| 7,382,888 | B2 * | 6/2008 | Aylward et al. | 381/97 |
| 7,391,869 | B2 * | 6/2008 | Eid et al. | 381/22 |
| 7,394,903 | B2 * | 7/2008 | Herre et al. | 381/23 |
| 7,412,380 | B1 * | 8/2008 | Avendano et al. | 704/216 |
| 7,447,629 | B2 * | 11/2008 | Breebaart | 704/219 |
| 7,460,990 | B2 * | 12/2008 | Mehrotra et al. | 704/206 |
| 7,508,947 | B2 * | 3/2009 | Smithers | 381/21 |
| 7,583,805 | B2 * | 9/2009 | Baumgarte et al. | 381/61 |
| 7,602,922 | B2 * | 10/2009 | Breebaart et al. | 381/23 |
| 7,974,713 | B2 * | 7/2011 | Disch et al. | 381/19 |
| 8,019,350 | B2 * | 9/2011 | Purnhagen et al. | 381/17 |
| 8,346,564 | B2 * | 1/2013 | Hotho et al. | 704/500 |
| 8,532,999 | B2 * | 9/2013 | Neusinger et al. | 704/500 |
| 2003/0206639 | A1 * | 11/2003 | Griesinger | 381/20 |
| 2004/0032960 | A1 | 2/2004 | Griesinger | |
| 2004/0044527 | A1 | 3/2004 | Thumpudi et al. | |
| 2005/0157883 | A1 | 7/2005 | Herre et al. | |
| 2005/0195981 | A1 * | 9/2005 | Faller et al. | 381/23 |
| 2006/0140412 | A1 * | 6/2006 | Villemoes et al. | 381/12 |
| 2006/0147048 | A1 * | 7/2006 | Breebaart et al. | 381/23 |
| 2006/0165184 | A1 * | 7/2006 | Purnhagen et al. | 375/242 |
| 2006/0165237 | A1 * | 7/2006 | Villemoes et al. | 381/20 |
| 2007/0168183 | A1 * | 7/2007 | Van De Kerkhof | 704/200.1 |
| 2007/0194952 | A1 * | 8/2007 | Breebaart et al. | 341/50 |
| 2007/0230710 | A1 * | 10/2007 | Van Loon et al. | 381/23 |
| 2008/0031463 | A1 * | 2/2008 | Davis | 381/17 |
| 2009/0055194 | A1 * | 2/2009 | Hotho et al. | 704/500 |
| 2010/0094631 | A1 * | 4/2010 | Engdegard et al. | 704/258 |
| 2010/0310079 | A1 * | 12/2010 | Jung et al. | 381/1 |
| 2011/0211703 | A1 * | 9/2011 | Villemoes et al. | 381/22 |
| 2013/0142339 | A1 * | 6/2013 | Engdegard et al. | 381/17 |
| 2013/0236021 | A1 * | 9/2013 | Purnhagen et al. | 381/20 |

FOREIGN PATENT DOCUMENTS

| | | |
|---|---|---|
| JP | 63-044600 | 3/1988 |
| JP | 05-020500 | 3/1993 |
| JP | 08-336199 | 12/1996 |
| JP | 2000-350300 | 12/2000 |
| JP | 2004/535145 | 11/2004 |
| JP | 2005/523624 | 8/2005 |
| RU | 2129336 C1 | 4/1999 |
| WO | 0004744 A1 | 1/2000 |
| WO | 03007656 A1 | 1/2003 |
| WO | WO03/007656 | 1/2003 |
| WO | 03/090206 | 10/2003 |
| WO | 03090206 A1 | 10/2003 |
| WO | 2005086139 A1 | 9/2005 |

OTHER PUBLICATIONS

ISR: PCT/IB05/052293.

Written Opinion: PCT/IB05/052293.

English Translation of Japanese Office Action Mailed Jul. 6, 2010 in related Japanese Application No. 520954/2007, 6 pages.

English translation of Russian Decision to Grant concerning Russian Patent Application 2007105501, said Decision mailed Dec. 2009, 12 pages.

J. Engdegard, H. Purnhagen, J. Röden, L. Liljeryd: "Synthetic ambience in parametric stereo coding" 116th AES Convention, May 8, 2004, XP002347433, 12 pages, Berlin, DE.

D. Griesinger: "Surround from Stereo", 13th AES Convention, Oct. 5, 2002, XP002347434, Los Angeles, USA.

Avendano C. et al.: "A Frequency-Domain Approach to Multichannel Upmix", Journal of the Audio Engineering Society, Audio Engineering Society, New York, US, vol. 52, No. 7/8, Jul. 1, 2004, pp. 740-749, XP001231780.

Griesinger, David , "Stereo and Surround Panning in Practice", Presented at the 112th Convention AES Engineering Society, Convention Paper 5564, May 2002, 6 pages.

* cited by examiner

METHOD AND DEVICE FOR DECORRELATION AND UPMIXING OF AUDIO CHANNELS

The present invention relates to audio channel conversion. More in particular, the present invention relates to a device and a method for converting a first number of input audio channels into a second number of output audio channels, the first number being smaller than the second number.

It is well known to convert a number of audio channels into another, larger number of audio channels. This may be done for various reasons. A first reason may be the conversion into a new format. Stereo recordings, for example have only two channels, while modern audio systems typically have five or six channels, as in the popular "5.1" systems. Accordingly, the two stereo channels have to be converted into five or six channels in order to take full advantage of the advanced audio system. The second reason may be coding efficiency. It has been found that stereo audio signals can be encoded as single channel audio signals combined with a parameter bit stream describing the spatial properties of the audio signal. The decoder can reproduce the stereo audio signals with a very satisfactory degree of accuracy. In this way, substantial bit rate savings may be obtained.

There are several parameters which describe the spatial properties of audio signals. One of those parameters is the inter-channel cross-correlation, for example in stereo signals the cross-correlation between the L channel and the R channel. Another parameter is the power ratio of the channels. In so-called parametric spatial audio (en)coders these and other parameters are extracted from the original audio signal so as to produce an audio signal having a reduced number of channels, for example only a single channel, plus a set of parameters describing the spatial properties of the original audio signal. In so-called parametric spatial audio decoders the original audio signal is substantially reconstructed.

A parametric spatial audio decoder typically comprises a number of decorrelation filters for producing sets of decorrelated auxiliary channels of each input audio channel. These decorrelated auxiliary channels are then combined with the original input channels in a so-called upmix unit to produce output channels having a desired correlation, that is, a correlation corresponding with the original audio signal. In addition to setting the correlation, the upmix unit typically also sets the power ratio of the audio channels and/or carries out other signal processing steps, such as predicting an audio channel on the basis of other channels.

The present inventors have found that the decorrelation filters introduce a time delay and a temporal "smearing" of the audio signal and that, as a result of this, there may be a temporal discrepancy between a signal part (for example the signal contained in a time frame) and its corresponding parameters: as the signal part is delayed, its parameters may be applied to another signal part, resulting in distortion of the signal. This is clearly undesirable. It is, however, not feasible to delete the decorrelation units from the decoder, as this would make it impossible to provide audio channels having a correct inter-channel correlation.

It is an object of the present invention to overcome these and other problems of the Prior Art and to provide a device and a method for converting the number of audio channels of an audio signal in which the disadvantageous effects of the decorrelation filters are significantly reduced or even eliminated.

Accordingly, the present invention provides a device for converting a first number of input audio channels into a second number of output audio channels, where the first number is smaller than the second number, the device comprising:

at least one decorrelation unit for producing a set of decorrelated auxiliary channels from an input audio channel, and at least one upmix unit for combining channels into output audio channels, said device further comprising:

at least one pre-processing unit for pre-processing the input audio channel prior to feeding the input audio channel to the at least one decorrelation unit.

By providing a pre-processing unit for pre-processing the input audio channels prior to processing by the decorrelation units, the audio channels can be (pre-)processed before any delay or "smearing" is introduced by the decorrelation units. As a result, the correct parameters are used for this processing and any misalignment of the signal parts and the parameters is avoided.

The at least one pre-processing unit is arranged such that the pre-processing takes place before the input audio channel is fed to the decorrelation unit(s). Accordingly, the pre-processing unit is arranged between an input terminal of the device and the at least one decorrelation unit.

The set of auxiliary channels derived from a single input audio channel may consist of one, two, three or more channels. Auxiliary channels may also be derived from intermediate channels, that is channels derived from the input audio channels by signal processing other than decorrelation, for example by prediction, as may be performed in the pre-processing unit of the present invention.

The upmix unit(s) may combine the input audio channel (or channels), the decorrelated auxiliary channel (or channels) and/or any intermediate channels in a known manner. In addition to combining (that is, mixing), the upmix unit may also perform scaling. However, in accordance with the present invention the processing of the auxiliary channels and the input audio channels, other than combining, is primarily or exclusively performed in the pre-processing unit.

The pre-processing unit(s) and/or the upmix unit(s) are preferably controlled by audio parameters. These units are therefore designed to be controlled by these units. This provides a greater flexibility and allows the pre-processing properties and/or upmix properties to be changed.

Accordingly, the pre-processing unit is preferably arranged for time-variant pre-processing. That is, the processing performed by the pre-processing units varies with time. More in particular, this processing is determined by time-varying signal parameters. The upmix unit is preferably also arranged for time-variant processing, such as time-variant decorrelation. In contrast, the decorrelation units are preferably arranged for time-invariant decorrelation.

The pre-processing unit(s) may advantageously be arranged for setting power ratios of audio channels and/or prediction. This prediction involves predicting the signals of certain audio channels on the basis of properties of other channels and prediction parameters.

It is noted that setting the correlations of the audio channels should be performed after the decorrelation units, that is, by the conventional upmix unit. All other signal processing, however, may take place in the pre-processing unit.

The present invention also provides an audio system comprising a device as defined above. The audio system may further comprise one or more audio sources, an amplifier and loudspeaker units or their equivalents.

The present invention additionally provides a method of converting a first number of input audio channels into a second number of output audio channels, where the first number is smaller than the second number, the method comprising the steps of:

producing a set of decorrelated auxiliary channels from an input audio channel, and combining channels into output audio channels, said method comprising the additional step of:

pre-processing the input audio channel prior to the step of producing the set of decorrelated auxiliary channels.

Preferably, audio parameters are used for controlling the combining step and the pre-processing step.

The present invention further provides a computer program product for carrying out the method as defined above. A computer program product may comprise a set of computer executable instructions stored on a data carrier, such as a CD or a DVD. The set of computer executable instructions, which allow a programmable computer to carry out the method as defined above, may also be available for downloading from a remote server, for example via the Internet.

The present invention will further be explained below with reference to exemplary embodiments illustrated in the accompanying drawings, in which:

FIG. 1 schematically shows a channel conversion device according to the Prior Art.

Figure 2:
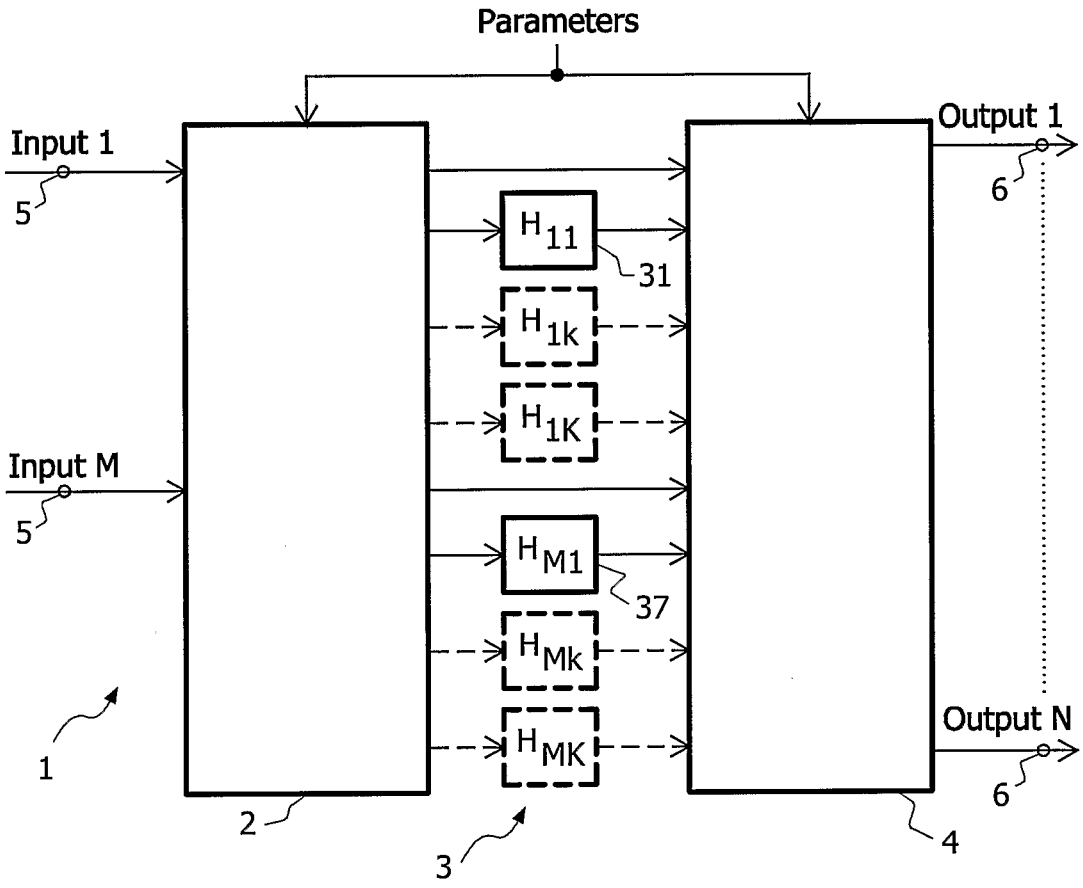

FIG. 2 schematically shows a first embodiment of a channel conversion device according to the present invention.

Figure 3:
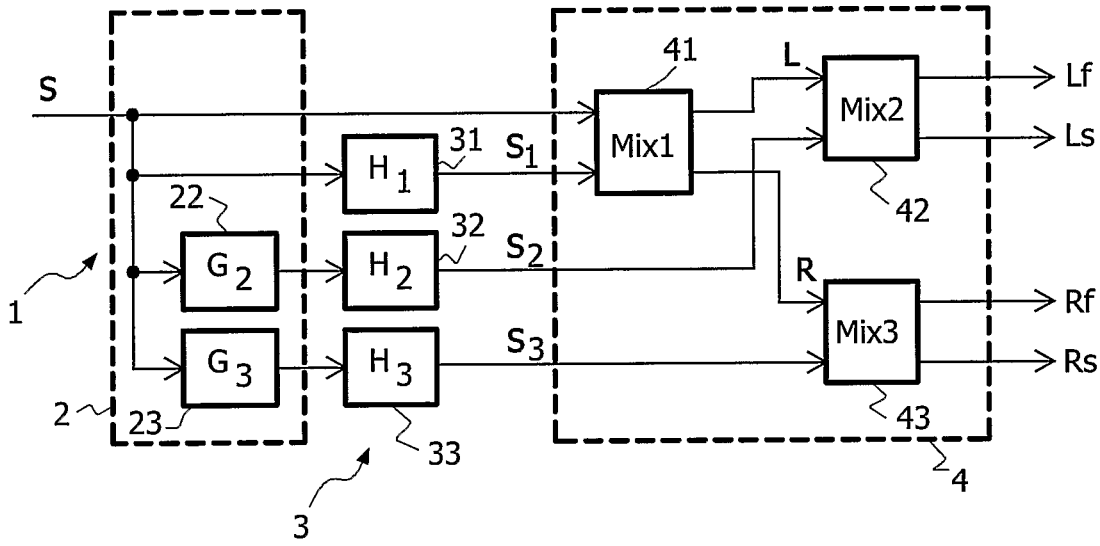

FIG. 3 schematically shows a second embodiment of the channel conversion device according to the present invention.

Figure 4:
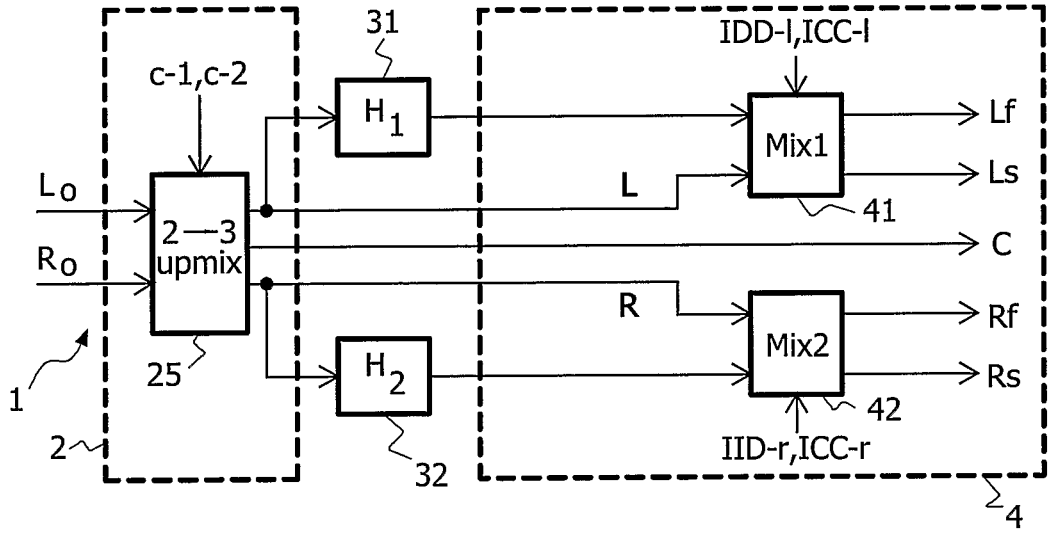

FIG. 4 schematically shows a third embodiment of the channel conversion device according to the present invention.

Figure 5:
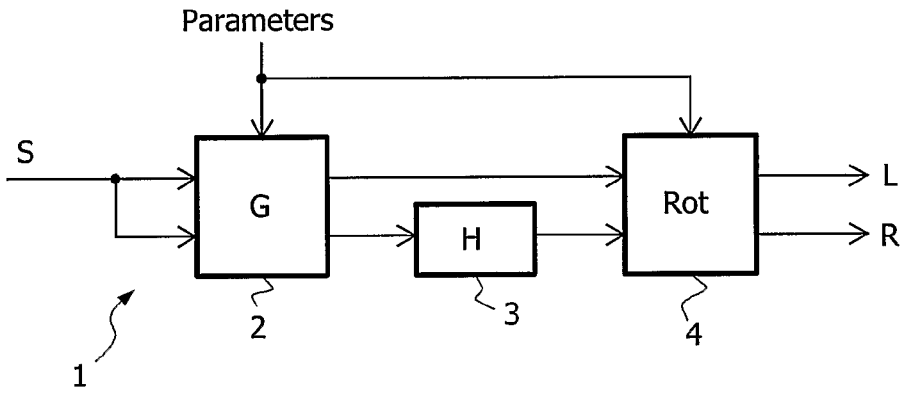

FIG. 5 schematically shows a fourth embodiment of the channel conversion device according to the present invention.

Figure 6:
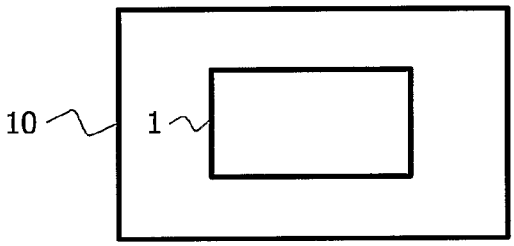

FIG. 6 schematically shows an audio system according to the present invention.

The Prior Art device 1' shown in FIG. 1 comprises an array 3 of decorrelation units and an upmix unit 4. The device has M inputs 5 and N outputs 6, which are all coupled to the upmix unit 4. Each input 5 receives an audio channel of a set of audio channels which together constitute a multiple-channel audio signal.

The number of output channels (N outputs 6) is greater than the number of input channels (M inputs 5). Exemplary values are N=6 and M=2, as when a stereo audio signal is converted into a 5.1 audio signal, or N=2 and M=1, as when a stereo signal is encoded as a mono signal plus additional information, although other values of M and N are also possible. The output channels typically have (mutual) correlations defined by parameters fed to the upmix unit 4. To produce output channels having the desired correlations, a set of mutually uncorrelated channels is derived from the input channels. To this end, decorrelation units 3 are coupled to each input 5 so as to produce sets of uncorrelated input channels. The actual number of decorrelation filters, which are well known in the art, may vary and is not limited to the number shown in the drawings.

The decorrelation units 31, . . . , 39 typically include filters having all-pass characteristics. Such filters substantially maintain the spectral envelope of the audio signal. However, the all-pass characteristics have the disadvantage of introducing a time delay. In addition, they often cause a "smearing" of the input signal, that is, the temporal envelope of the decorrelated signal is less well-defined than the temporal envelope of the original signal. Both the time delay and the "smearing" result in a discrepancy between the audio signal and the corresponding parameters: some signal parts (that is, time segments of the signal produced by decorrelation filters) reach the upmix unit later than the corresponding parameters. As a result, the wrong parameters are applied to these signal parts and the audio signal is processed incorrectly, leading to a perceptible signal distortion, for example cross-talk. It will be understood that this is highly undesirable.

It is noted that the parameters could be delayed (e.g. be a delay unit) so as to better match the timing of the parameters and the signals. However, the upmix unit 4 also receives the un-decorrelated input signals, which have not been delayed. In addition, the "smearing" may be frequency-dependent. As a result, it is difficult to match the parameters and the corresponding signal parts.

The present invention solves this problem by processing the audio signal prior to the decorrelation. That is, a substantial part of the signal processing is performed before the audio signal is fed to the decorrelation filters. In this way, the mismatch caused by the decorrelation filters is largely avoided.

The device 1 according to the present invention and illustrated merely by way of non-limiting example in FIG. 2 also comprises an array 3 of decorrelation filters (31, . . . ) and an upmix unit 4. In contrast to the Prior Art device 1' of FIG. 1, however, the device 1 of the present invention additionally comprises a pre-processing unit 2 for pre-processing the audio signal prior to the decorrelation.

The pre-processing unit 2 receives the M input channels of the audio signal through the M inputs 5. The unit 2 also receives parameters relating to the audio signal, which are indicative of desired signal properties. Using these parameters, the pre-processing unit 2 performs signal processing such as adjusting the power ratios of the audio channels and predicting some audio channels on the basis of other audio channels. As a result, power ratio adjustment and prediction are carried out without being influenced by the decorrelation filters 3, and any time mismatch between the audio signal and the parameters relating to these operations is avoided.

It will be understood that not all signal processing can be performed by the pre-processing unit. Setting the desired correlations of the audio channels typically requires the availability of uncorrelated channels as produced by the decorrelation filters 3. Accordingly, setting the correlations is performed by the upmix unit 4. In addition, additional signal adjustments may be made by the upmix unit 4, such as an additional adjustment of the power levels of the audio channels. In this case, the power adjustment may be carried out in both the pre-processing unit 2 and the upmix unit 4, although it is very well possible to perform this operation in only one of these units.

An additional advantage of the present invention is the possibility to choose which of the units 2 and 4 is best suitable for performing a certain signal processing operation. By providing two units (2 and 4) instead of a single unit (4), a greater design flexibility is achieved, and the unfavorable effects of the decorrelation units can be avoided to the greatest extent possible.

In the preferred embodiments of the present invention, the pre-processing unit 2 and the upmix unit 4 are both time-variant: their signal processing properties are controlled by signal parameters which may vary in time. The decorrelation filters 3, however, are preferably time-invariant: their properties are not time-dependent and are preferably not controlled by signal parameters that vary over time. Embodiments can be envisaged in which either the pre-processing unit 2 or the upmix unit 4 is time-invariant.

In further advantageous embodiments, the processing performed by the pre-processing unit 2 and/or the upmix unit 4 is frequency-dependent: the signal processing properties of these units may be controlled by parameters which vary in dependence of the frequency.

As mentioned above, the number of output channels (N) is greater than the number of input channels (M). For example, there may be two input channels and five or six output channels, or there may be a single input channel and two or more output channels, although other combinations are possible.

It is also possible that the number of output channels 6 is equal to the number of input channels 5 (that is, M=N), in which case the device of the present invention provides a remix of the audio channels. This may be useful to adjust certain signal properties and to enhance the audio signal.

It is noted that the audio signal may be constituted by a series of signal parts contained in consecutive time segments. Such time segments may be time frames or other units defining a time-limited signal part. Due to the decorrelation units the synchronization between the time segments and the corresponding parameters may be lost. This problem is solved by the present invention.

A merely exemplary embodiment of the device of the present invention is shown in more detail in FIG. 3. The device 1 of FIG. 3 receives a single channel audio input signal (M=1). In the exemplary embodiment of FIG. 3 the pre-processing unit 2 comprises two gain units 22 and 23 having respective gains $G_2$ and $G_3$. The gain units 22 and 23 set the levels of the audio auxiliary channels before these auxiliary channels are decorrelated by respective decorrelation units 31, 32, 33 of a set (array) 3 of decorrelation units. Each of the decorrelation units 31, 32 and 33 has a respective transfer function $H_1$, $H_2$ and $H_3$ and produces a respective decorrelated auxiliary channel $S_1$, $S_2$ and $S_3$.

A (first) gain unit 21 having a gain $G_1$ could be added between the input terminal and the first decorrelation unit 31 but has been omitted from the embodiment shown where the first gain $G_1$ is equal to 1.

The upmix unit 4 comprises, in the example shown, three mixing units 41, 42 and 43 which mix the input channel and its three auxiliary channels to produce four output channels Lf (Left front), Ls (Left surround), Rf (Right front) and Rs (Right surround). The mixing unit 41 receives the (time-dependent) parameters IID_lr (Inter-channel Intensity Difference left-right) and ICC_lr (Inter-channel Cross-Correlation left-right), the mixing unit 42 receives the (time-dependent) parameters IID_l (Inter-channel Intensity Difference left front-left surround) and ICC_l (Inter-channel Cross-Correlation left front-left surround), while the mixing unit 43 receives the (time-dependent) parameters IID_r (Inter-channel Intensity Difference right front-right surround) and ICC_r (Inter-channel Cross-Correlation right front-right surround).

The parameters mentioned above are typically used in a so-called mixing matrix to determine the desired output signals. For example, the output signals Rf (Right front) and Rs (Right surround) may be determined by a mixing matrix M of mixing unit 43:

$$\begin{bmatrix} Rf \\ Rs \end{bmatrix} = \begin{bmatrix} m_{11} & m_{12} \\ m_{21} & m_{22} \end{bmatrix} \begin{bmatrix} R \\ H_3(G_3 \cdot S) \end{bmatrix} \tag{1}$$

where the matrix M has coefficients $m_{11} \ldots m_{22}$, and where $H_3(G_3 \cdot S)=S_3$ is the output signal of decorrelation unit 33. The normalized correlation coefficient ICC of the signals Rf and Rs is given by:

$$ICC(Rf, Rs) = \frac{m_{11}m_{21}\sigma_R^2 + m_{12}m_{22}\sigma_{S3}^2}{\sqrt{(m_{11}^2\sigma_R^2 + m_{12}^2\sigma_{S3}^2)(m_{21}^2\sigma_R^2 + m_{22}^2\sigma_{S3}^2)}} \tag{2}$$

where $\sigma^2_x$ is the power of signal x. The intensity ratio IID is given by:

$$IID(Rf, Rs) = \frac{(m_{11}^2\sigma_R^2 + m_{12}^2\sigma_{S3}^2)}{(m_{21}^2\sigma_R^2 + m_{22}^2\sigma_{S3}^2)} \tag{3}$$

As the total power should be unaltered, it follows that:

$$\sigma_R^2 = m_{11}^2\sigma_R^2 + m_{12}^2\sigma_{S3}^2 + m_{21}^2\sigma_R^2 + m_{22}^2\sigma_{H3}^2 \tag{4}$$

It has been found that the further constraint $m_{12}=-m_{22}$ is effective. In other words, the power of the intermediate signal (auxiliary channel) $S_3$ in both signals Rf and Rs is equal but has opposite signs (anti-phase). If $m_{12}=-m_{22}$ holds, the factors $m_{12}$ and $m_{22}$ can be moved upstream of decorrelator unit 33, for example to gain unit 23, to allow processing prior to decorrelation. Equation (1) can then be rewritten as:

$$\begin{bmatrix} Rf \\ Rs \end{bmatrix} = \begin{bmatrix} m_{11} & 1 \\ m_{21} & -1 \end{bmatrix} \begin{bmatrix} R \\ H_3(G_3 \cdot m_{12} \cdot S) \end{bmatrix} \tag{1'}$$

Equation (1') can be generalized using a parameter c:

$$\begin{bmatrix} Rf \\ Rs \end{bmatrix} = \begin{bmatrix} m_{11} & c \\ m_{21} & -c \end{bmatrix} \begin{bmatrix} R \\ H_3\left(G_3 \cdot \frac{m_{12}}{c} \cdot S\right) \end{bmatrix} \tag{1''}$$

For c=1 all time-variant processing of the decorrelator signal path is performed upstream of the decorrelator, while for $c=G_3 \cdot m_{12}$ all time-variant processing of the decorrelator signal path is performed downstream of the decorrelator. In accordance with the present invention, the parameter c will preferably have a value approximately or substantially equal to 1.

In the exemplary embodiment described above the upmix unit 4 sets both the cross-correlation and the intensity difference of the four output channels. This is, of course, not essential and in some embodiments the inter-channel intensity may be set in the pre-processing unit 2. This may be accomplished by performing all mixing operations in the pre-processing unit 2, for example directly using the input signal S.

It can be seen from FIG. 3 that in accordance with the present invention a pre-processing operation is carried out, in the example shown a gain (that is, power) adjustment.

Another example of a device 1 according to the present invention is illustrated in FIG. 4 where an audio signal comprised of two input audio channels $L_0$ and $R_0$ is converted into an audio signal consisting of five output audio channels Lf, Ls, C (Center), Rf and Rs. The pre-processing unit 2 comprises a single mixing unit 25 which receives the (time-dependent) signal parameters c_1 and c_2. The parameters c_1 and c_2 are prediction parameters for predicting the intermediate signals L, C and R output by the mixing unit 25 on the basis of the input signals $L_0$ and $R_0$. The decorrelation units 31 and 32 produce uncorrelated counterparts of the intermediate channels L and R which are then fed to the upmix unit 4. The operation of the mixing units 41 and 42 of the upmix unit 4 is similar to the operation of the mixing units 41-43 in the embodiment of FIG. 3.

As can be seen from FIG. 4, part of the processing is carried out by the processing unit 4, prior to the decorrelation. This is particularly advantageous when prediction is used as decorrelators tend to distort the original waveform, while a correct prediction requires the original waveforms to be unaltered. Prediction carried out before decorrelation therefore yields much better results. It will be understood that instead of a single pre-processing unit 2, two or more of such units may be present, for example one pre-processing unit performing prediction operations and another pre-processing unit performing mixing and/or scaling operations.

An exemplary stereo decoder in accordance with the present invention is illustrated in FIG. 5. The stereo decoder of FIG. 5 is essentially a device 1 according to the present invention having a single input (M=1) and two outputs (N=2). The pre-processing unit 2 performs a scaling operation (gain G) and produces two intermediate channels, one of which is decorrelated by the decorrelation unit 3 (transfer function H). An upmix unit 4 performs a rotation operation (Rot) so to rotate the spatial orientation of the signal. It is noted that multiple channel signal rotation is well known in the art. Signal rotation is discussed in more detail in International Patent Application WO 03/090206 (Applicant's Reference PHNL020639EPP), the entire contents of which are herewith incorporated in this document.

An audio system 10 according to the present invention is schematically illustrated in FIG. 6. The audio system 10 is shown to comprise a device 1 for converting a first number of input audio channels into a second number of output audio channels as discussed above.

Accordingly, the present invention may be used in audio amplifiers and/or systems. Such audio systems may include one or more audio sources, an amplifier and loudspeaker units or their equivalents. The audio sources may include a CD player, a DVD player, an MP3 or AAC player, a radio tuner, a hard disk, and/or other sources. The audio system may be incorporated in an entertainment center or in a computer system.

As discussed above, the present invention provides both a device and a method. The method steps are evident from FIG. 2, where the step of pre-processing the input audio channels prior to the step of decomposing the input audio channels into a set of decorrelated auxiliary channels is carried out by the pre-processing unit 2, the step of decomposing the input audio channels into a set of decorrelated auxiliary channels is carried out by the array 3 of decorrelation units (31, 32, . . . ), and the step of converting the decorrelated auxiliary channels, preferably in combination with the input audio channels and/or any intermediate channels, into the output audio channels is carried out by the upmix unit 4.

The present invention is based upon the insight that the time delay and possible "smearing" caused by the decorrelation in an audio decoder may cause temporal alignment discrepancies between the signal parameters and the corresponding signal parts. The present invention benefits from the further insight that this discrepancy can be eliminated, at least for certain signal processing operations, by carrying out these operations prior to the decorrelation.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A device for converting a first number of input audio channels into a second number of output audio channels, where the first number is smaller than the second number, the device comprising:

at least one decorrelation unit for producing a set of decorrelated auxiliary channels from an input audio channel, the set of decorrelated auxiliary channels including one or more decorrelated auxiliary channels; and at least one upmix unit for combining channels into output audio channels, wherein the at least one upmix unit is operative to combine an input audio channel or a pre-processed input audio channel and a decorrelated auxiliary channel based on a time-varying inter-channel cross correlation parameter, said device further comprising:

at least one pre-processing unit for pre-processing the input audio channel prior to feeding the input audio channel to the at least one decorrelation unit, wherein the at least one pre-processing unit is operative to perform a time-varying signal processing other than setting correlations, wherein the at least one decorrelation unit, the at least one upmix unit or the at least one pre-processing unit is implemented by a computer.

2. The device as claimed in claim 1, wherein the at least one pre-processing unit and the at least one upmix unit are controlled by audio parameters.

3. The device as claimed in claim 1, wherein the at least one pre-processing unit is arranged for time-variant preprocessing.

4. The device as claimed in claim 1, wherein the at least one decorrelation unit is arranged for time-invariant decorrelation.

5. The device as claimed in claim 1, wherein the upmix unit is arranged for time-variant decorrelation.

6. The device as claimed in claim 1, wherein the preprocessing unit is arranged for setting power ratios of audio channels and/or for prediction.

7. The device as claimed in claim 1, wherein the first number is equal to one.

8. The device as claimed in claim 1, wherein the first number is equal to two.

9. An audio system, comprising a device as claimed in claim 1.

10. A method of converting a first number of input audio channels into a second number of output audio channels, where the first number is smaller than the second number, the method comprising:

producing a set of decorrelated auxiliary channels from an input audio channel, the set of decorrelated auxiliary channels including one or more decorrelated auxiliary channels; and combining channels into output audio channels, wherein the combining comprising combining an input audio channel or a pre-processed input audio channel and a decorrelated auxiliary channel based on a time-varying inter-channel cross correlation parameter, said method additionally comprising:

pre-processing the input audio channel prior to the producing the set of decorrelated auxiliary channels from the input audio channel, wherein the pre-processing comprises performing a time-varying signal processing other than setting correlations, wherein the producing, combining, or pre-processing is performed using a processor.

11. The method as claimed in claim 10, wherein audio parameters are used in the combining and the pre-processing.

12. The method as claimed in claim 10, wherein the step of pre-processing comprises setting power ratios of audio channels and/or prediction.

13. A computer program product for carrying out the method as claimed in claim 10, wherein the computer product comprises a set of computer executable instructions stored on a data carrier.

* * * * *